US006467929B2

(12) United States Patent
Lee

(10) Patent No.: US 6,467,929 B2
(45) Date of Patent: Oct. 22, 2002

(54) APPARATUS FOR ATTACHING OR MOUNTING A LASER DIODE MODULE

(76) Inventor: Razgo Lee, 22125 Birds Eye Dr., Diamond Bar, CA (US) 91765

( * ) Notice: Subject to any disclaimer, the term of this patent is extended or adjusted under 35 U.S.C. 154(b) by 0 days.

(21) Appl. No.: 09/908,274

(22) Filed: Jul. 18, 2001

(65) Prior Publication Data

US 2002/0021566 A1 Feb. 21, 2002

Related U.S. Application Data

(63) Continuation of application No. 09/398,895, filed on Sep. 20, 1999, now abandoned.

(51) Int. Cl.[7] ..... F21L 7/60; F21L 15/08

(52) U.S. Cl. ..... 362/191; 362/190; 362/806; 362/259; 362/287; 362/427

(58) Field of Search ..... 362/259, 199, 362/197, 105, 190, 191, 201, 396, 427, 430, 419, 421, 806, 287

(56) References Cited

U.S. PATENT DOCUMENTS 4,160,285 A * 7/1979 Shibla ..... 362/145
4,265,561 A * 5/1981 Heckele ..... 362/105
4,967,323 A * 10/1990 Johnson et al. ..... 362/105
5,103,384 A * 4/1992 Drohan ..... 362/191
5,268,826 A * 12/1993 Greene ..... 362/103
5,284,345 A 2/1994 Jehn ..... 273/187.2
5,446,635 A * 8/1995 Jehn ..... 362/259
5,558,428 A * 9/1996 Lehrer et al. ..... 362/105
5,573,329 A * 11/1996 Va Gennep ..... 362/191
5,683,171 A * 11/1997 Van Gennep ..... 362/191
5,951,149 A * 9/1999 Lee ..... 362/259
6,024,467 A * 2/2000 Liu ..... 362/259
6,062,702 A * 5/2000 Krietzman ..... 362/158
6,142,650 A 11/2000 Brown et al. ..... 362/249

* cited by examiner

*Primary Examiner*—Thomas M. Sember
(74) *Attorney, Agent, or Firm*—Chan Law Group LC

(57) ABSTRACT

A laser diode module attachment and mounting apparatus for adjustably mounting a laser diode module onto a fixed object, such as a pole, table edge, or refrigerator or the like, or an item of apparel, such as a cap, belt, pants, shirt or the like, thereby enhancing not only the practical applications for the Laser Diode, but also furthering its entertainment appeal. The laser diode module attachment and mounting apparatus allows for aiming, and hence projecting, a laser image on a desired target while the laser diode module is either attached to an item of apparel worn by the user or mounted onto an object. The apparatus generally comprises a first means for attaching a laser diode module onto an object, a second means for adjusting a laser diode module, and an attachment mechanism for securing the laser diode module onto the second adjusting means. The second adjusting means allows for rotation, and hence, aiming of the laser diode module around one rotational axis or around a plurality of rotational axes.

31 Claims, 13 Drawing Sheets

APPARATUS FOR ATTACHING OR MOUNTING A LASER DIODE MODULE

CROSS-REFERENCE TO RELATED APPLICATIONS

This application is a continuation of U.S. application Ser. No. 09/398,895 filed on Sep. 20, 1999, which is now abandoned.

STATEMENT REGARDING FEDERALLY SPONSORED RESEARCH OR DEVELOPED

Not applicable

REFERENCE TO A MICROFICHE APPENDIX

Not applicable

BACKGROUND OF THE INVENTION

1. Field of the Invention

This invention pertains generally to mounting devices, and more particularly, to a laser diode module mounting apparatus.

2. Description of the Background Art

Use of portable electronic devices, such as pagers, cellular telephones, and walkie-talkies have become widely prevalent. Since portability is inherent with such electronic devices, many various attachment or mounting apparatuses have been developed and used to allow for the attachment of these electronic devices onto a person's apparel. There have also been many attachment or mounting apparatuses that also allow for the convenient storage of these electronic devices by placement onto a holder, rack, or the like. All the attachment or mounting apparatuses, however, do not allow for the use of the electronic device when the device is either attached to the person's apparel or otherwise mounted onto an object.

A need for using or operating a portable electronic device arises from a portable electronic device used for projecting a laser-based image. An example of such an electronic device is known as Laser Diode manufactured by Transverse Industries Company, Ltd. The Laser Diode is a battery powered laser emitter that is capable of projecting a variety of images onto a variety of surfaces. The Laser Diode is enclosed within a generally modular housing. Unlike a laser pointing device, which only projects a dot on the targeted surface, the Laser Diode is capable of projecting images, such as a sun, moon, star, happy face, or flying saucer. It is conceivable that in addition to the aforementioned images, letters, initials, acronyms, words, phrases, slogans or sentences may also be projected by such laser emitting devices.

Although the Laser Diode may be held by the user and pointed at a desired location while projecting the image, it is often desireable to project the image at a desired location while the Laser Diode is attached onto some apparel worn by the user or while the Laser Diode is mounted onto a fixed object, such as a pole, table edge, or refrigerator or the like. This enhances not only the practical applications for the Laser Diode, but also furthers its entertainment appeal at, for example, a party, during a concert, when camping or during night events and activities.

Accordingly, there is a need for an apparatus for attaching or mounting a laser diode. module that enables the laser diode module to be aimed or pointed at a specified location while the laser diode module is either attached to some item of apparel worn by the user or otherwise mounted on an object. The present invention satisfies these needs, as well as others, and generally solves the deficiencies found in the background art.

BRIEF SUMMARY OF THE INVENTION

The present invention pertains to a laser diode module attachment and mounting apparatus that allows for aiming, and hence projecting, a laser image on a desired target while the laser diode module is either attached to an item of apparel worn by the user or mounted onto an object. By way of example and not of limitation, the laser diode module attachment and mounting apparatus generally comprises a first means for attaching a laser diode module onto an object, a second means for adjusting a laser diode module connected to the first means for attaching the laser diode module, and an attachment mechanism for securing second adjustment means to the laser diode module.

The first means for attaching a laser diode module is adapted for the attachment or mounting onto an item of apparel or otherwise a generally fixed object. The second means for adjusting a laser diode module is connected to the first attaching means and allows for the directional positioning and adjustment of a laser diode module around one axis of rotation and/or two axis of rotation. The attachment mechanism affixes the laser diode module to the second adjustment means, and therefore renders the laser diode module adjustable when the first attachment means is attached or mounted to an object.

The present invention has been outlined in a rather broad fashion in order that the detailed description that follows may be better understood, and in order that the present contribution to the art may be better appreciated. There are additional features of the invention that will be described hereinafter and which will form the subject matter of the claims appended hereto.

An object of the invention is to provide a means for attaching a laser diode module to an item of apparel.

Another object of the invention is to provide a means for mounting a laser diode module onto a fixed object.

Still another object of the invention is to provide a means for attaching or mounting a laser diode module that allows for directional adjustability of the laser diode module when attached on an item of apparel or mounted on a fixed object.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DETAILED DESCRIPTION OF THE INVENTION

Referring more specifically to the drawings, for illustrative purposes the present invention is embodied in the apparatus generally shown in FIG. 1 through FIG. 16. It will be appreciated that the apparatus may vary as to configuration and as to details of the parts without departing from the basic concepts as disclosed herein.

Figure 1:
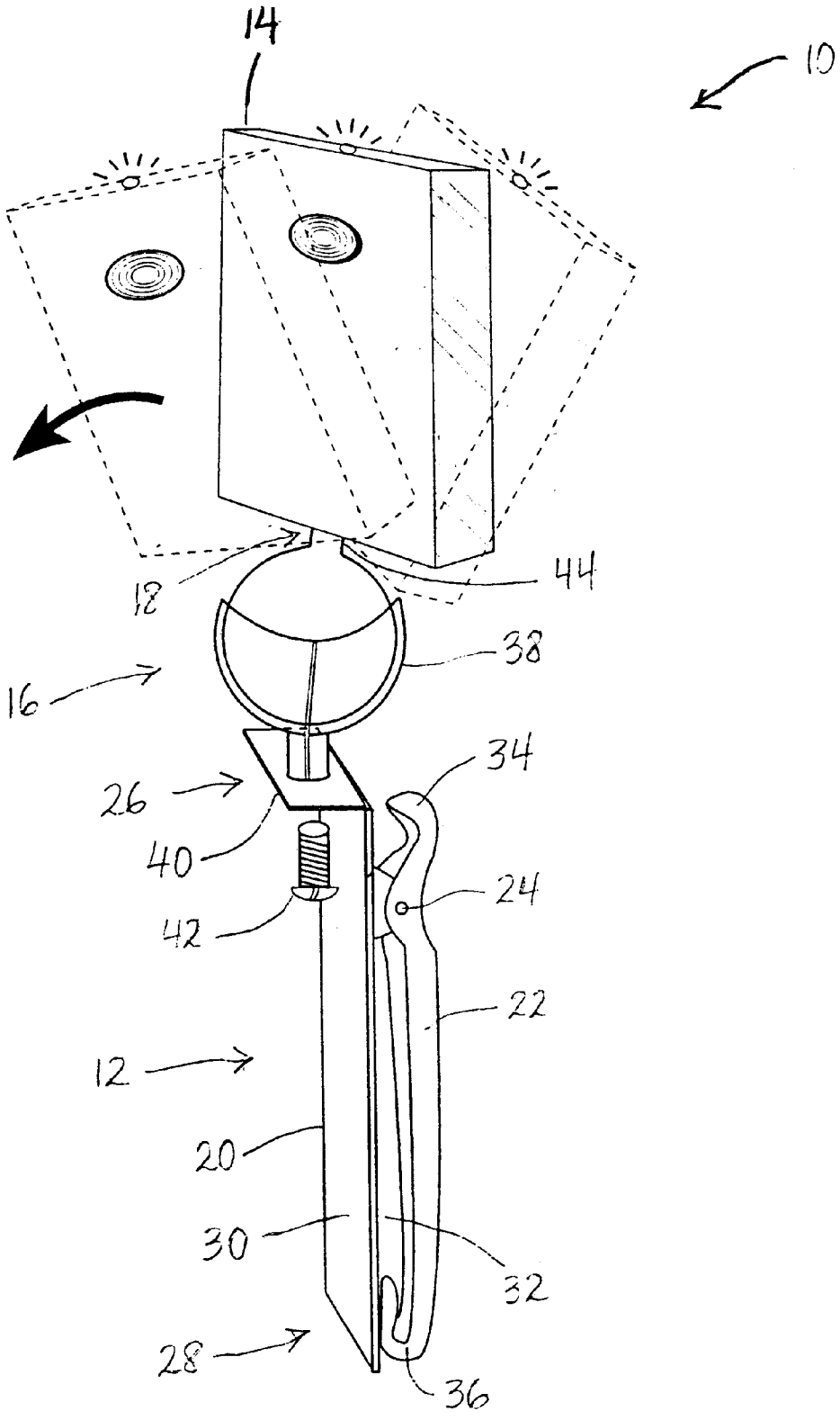
FIG. 1 is a perspective view of an apparatus for attaching or mounting a laser diode module in accordance with the present invention, shown with a first embodiment of a first means for attaching or mounting the laser diode module and a first embodiment of a second means for adjusting the laser diode module.

Referring first to FIG. 1, an apparatus 10 for attaching or mounting a laser diode module, in accordance with the present invention, is generally shown. Apparatus 10 comprises a first means 12 for attaching a laser diode module 14, a second means 16 for adjusting laser diode module 14, and an attachment mechanism 18 for securing second means 16 for adjusting laser diode module 14 to laser diode module 14.

First means 12 for attaching a laser diode module 14 generally comprises a plate 20, a gripping member 22, a pivot assembly 24, and a spring (not shown). Plate 20 includes an upper end 26, a lower end 28, a front face 30, and a rear face 32. Gripping member 22 is disposed on rear face 32 of plate 20 and includes an upwardly disposed handle 34 and a lower extent 36. Pivot assembly 24 couples gripping member 22 to plate 20 while providing for pivotal motion of gripping member 22 relative to plate 20. The spring located within pivot assembly 24 biases gripping member 22 by compressing lower extent 36 of gripping member 22 against rear face 32 of plate 20 while in a rest position.

Second means 16 for adjusting laser diode module 14 comprises a ball and socket joint 38 and a support member 40. Support member 40 is integrally coupled to upper end 26 of plate 20 and extends generally perpendicularly from front face 30 of plate 20. Ball and socket joint 38 is connected to support member 40 by a screw 42. Other forms of connecting ball and socket joint 38 to support member 40 are contemplated, such as but not limited to, glueing or press fitting.

Laser diode module 14 is secured to ball and socket joint 38 by attachment mechanism 18, which are threads (not shown) within laser diode module 14 adapted to receive a stud 44 extending from ball and socket joint 38. This allows for the removal and replacement of laser diode module 14 from apparatus 10 as desired or necessary.

It can therefore be seen that first means 12 is attachable onto an object or item such as, for example, a belt, a cap visor, or an article of clothing, while allowing for the directional adjustability of laser diode module 14 in any direction as shown in FIG. 1.

Figure 2:
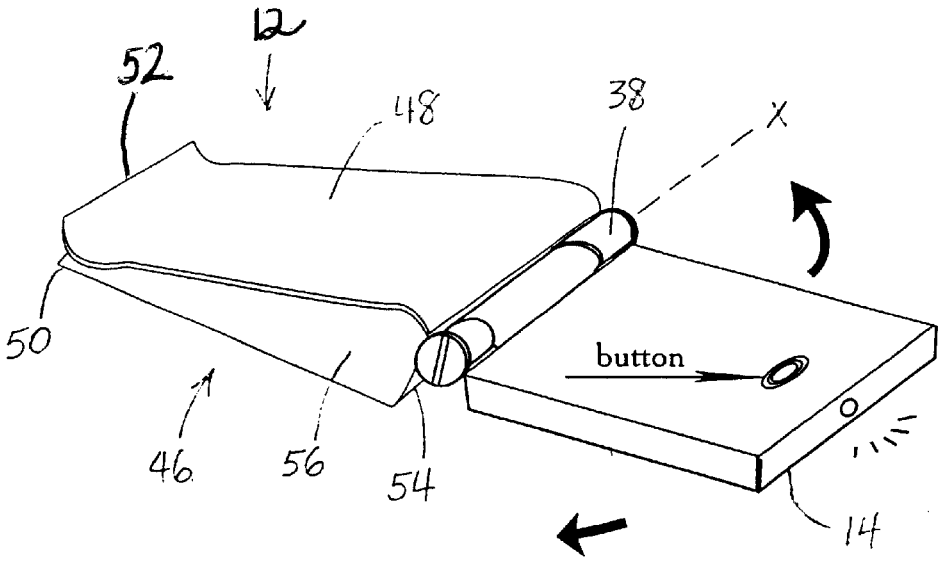
FIG. 2 is a perspective view of an apparatus for attaching or mounting a laser diode module shown with a second embodiment of a first means for attaching or mounting the laser diode module, along with a second embodiment of a second means for adjusting the laser diode module.
Figure 3:
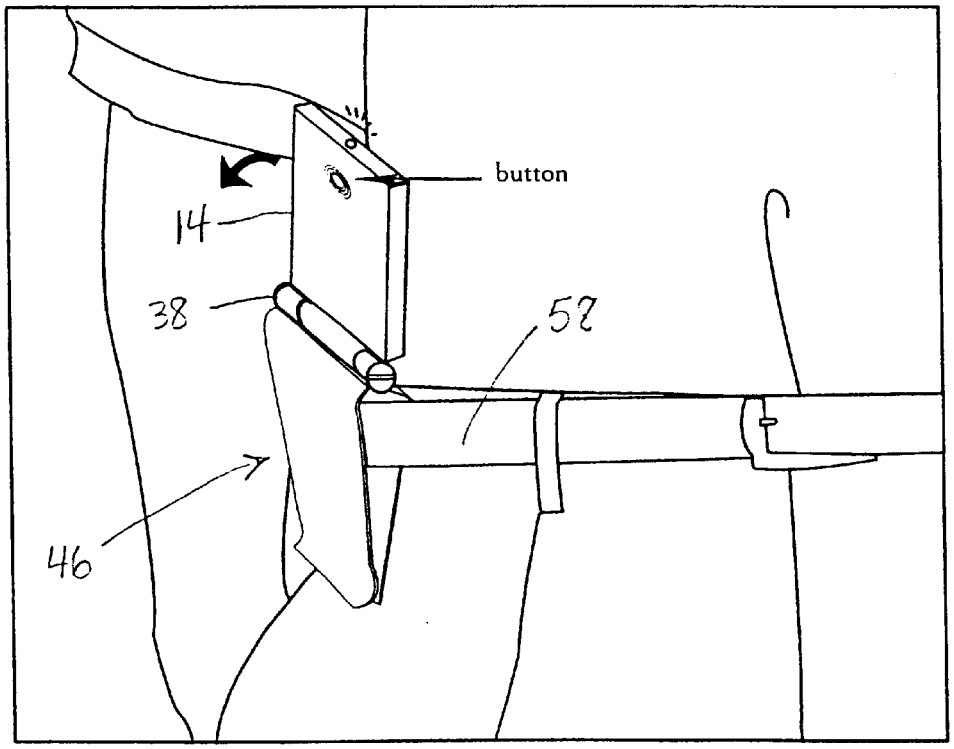
FIG. 3 is a perspective view of the apparatus shown in FIG. 2, shown attached to a belt.

Referring also to FIG. 2 and FIG. 3, a second embodiment 46 of first means 12 for attaching or mounting a laser diode module 14, in accordance with the present invention, is generally shown. Second embodiment 46 of first means 12 for attaching or mounting laser diode module 14 comprises a planar strip 48 having a first edge 50, a second edge 52, and a center section 54. Center section 54 is curved over such that first edge 50 is disposed generally adjacent second edge 52. First edge 50, second edge 52, and center section 54 define a gap 56 that tapers from center section 54 towards both first edge 50 and second edge 52. Second edge 52 is curved slightly away from first edge 50 to facilitate the insertion of an object therebetween.

In second embodiment 46 of first means 12 for attaching or mounting a laser diode module 14, second means 16 for adjusting laser diode module 14 may also include a first hinge assembly 38. First hinge assembly 38 is capable of pivoting around a first axis "x" and may be glued of otherwise integrally molded to second embodiment 46 of first means 12 for attaching or mounting a laser diode module 14. First hinge assembly 38 is secured onto laser diode module 14 by a tab (not shown) inserted into laser diode module 14 or otherwise integrally molded thereto.

It can be seen that second embodiment 46 of first means 12 for attaching or mounting a laser diode module 14 is attachable onto an object or item of apparel, such as, for example, a belt 58. It is also contemplated that second embodiment 46 of first means 12 for attaching or mounting a laser diode module 14 is also attachable onto, a cap (not shown), or an article of clothing, while allowing for the directional adjustability of laser diode module 14 in any direction around a single axis.

Figure 4:
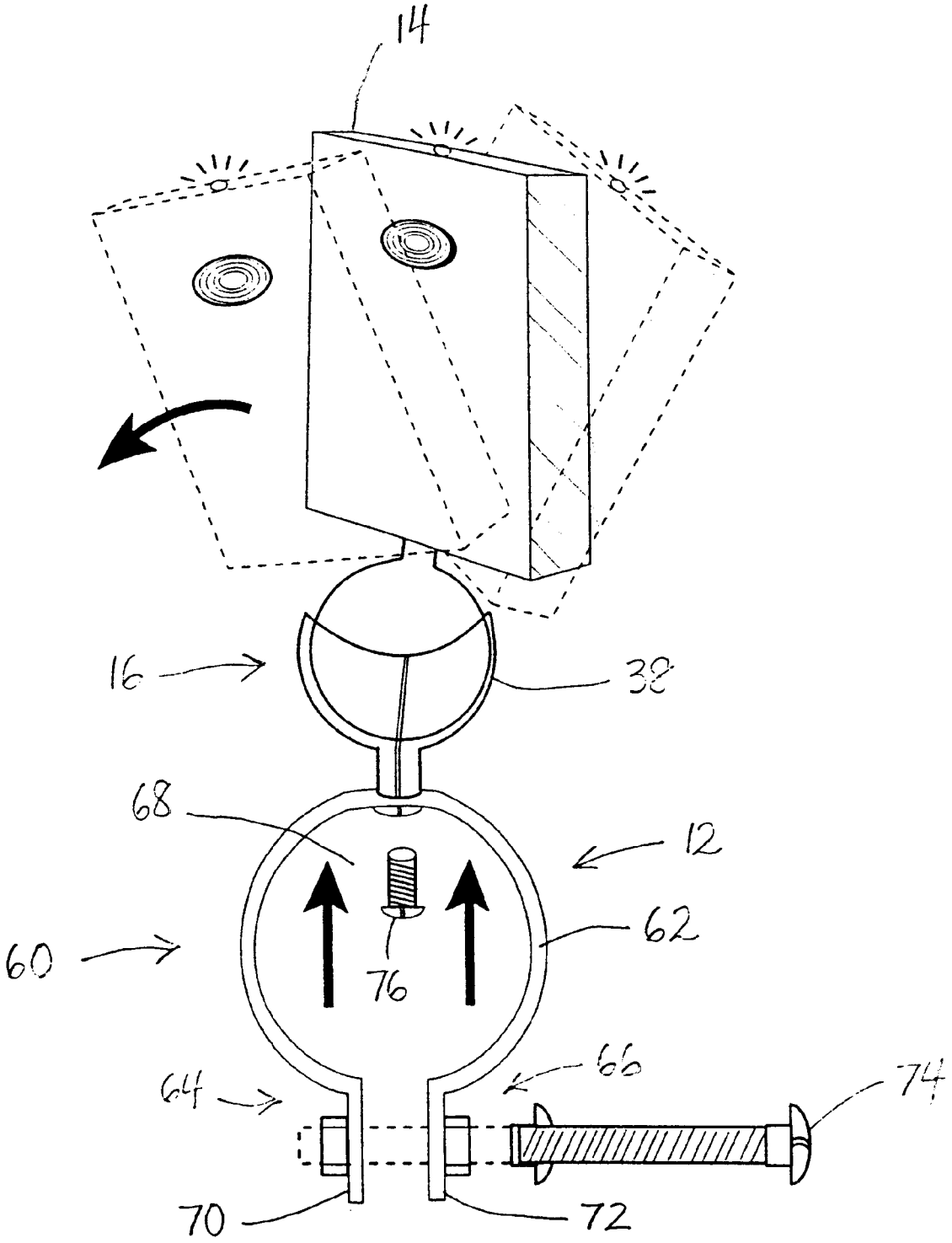
FIG. 4 is a perspective view of an apparatus for attaching or mounting a laser diode shown with a third embodiment of a first means for attaching or mounting the laser diode module, along with a first embodiment of a second means for adjusting the laser diode module.
Figure 5:
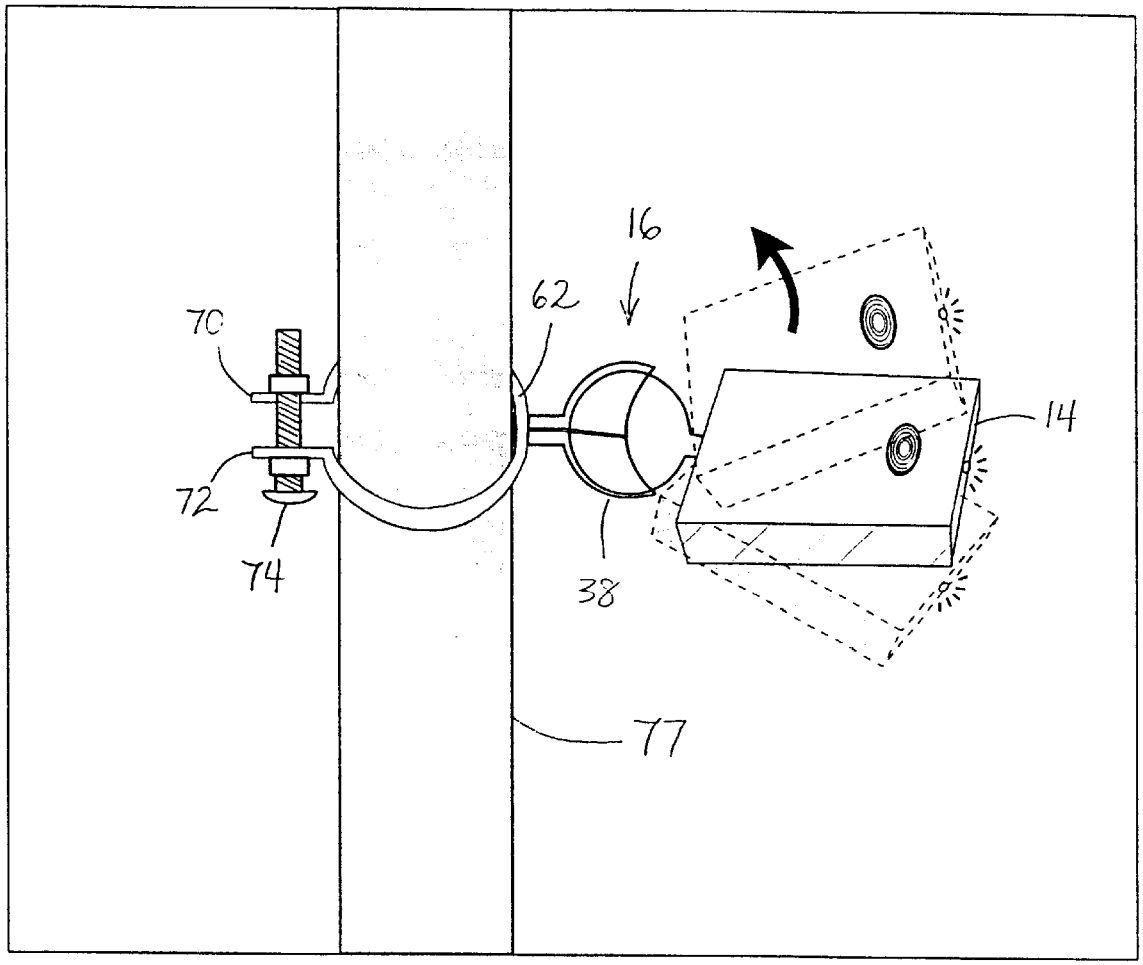
FIG. 5 is a perspective view of the apparatus shown in FIG. 4, shown attached to a pole.

Referring also to FIG. 4 and FIG. 5, a third embodiment 60 of first means 12 for attaching or mounting a laser diode module 14, in accordance with the present invention, is generally shown. Third embodiment 60 of first means 12 comprises a strip 62 having a first end 64 and a second end 66. Strip 62 is curved such that a generally circular opening 68 is formed therein. Strip further comprises a first tang 70 and a second tang 72. First tang 70 extends outwardly from first end 64 of strip 62, while second tang 72 extends outwardly from second end 66 of strip. First tang 70 and second tang 72 are generally parallel to each other and incorporate a bolt means 74 for holding tangs 70 and 72 is a fixed position relative to each other. In third embodiment 60 of first means 12, adjustment mechanism 16 may also include ball and socket joint 38. Ball and socket joint 38 is connected to third embodiment 60 of first means 12 by a bolt or screw 76.

It can be seen that third embodiment 60 of first means 12 is ideally adapted for attachment around a generally linear object, such as a pole 77 or the like, and tightening bolt means 74 reduces the area of opening 68 to secure strip 62 onto such object.

Figure 6:
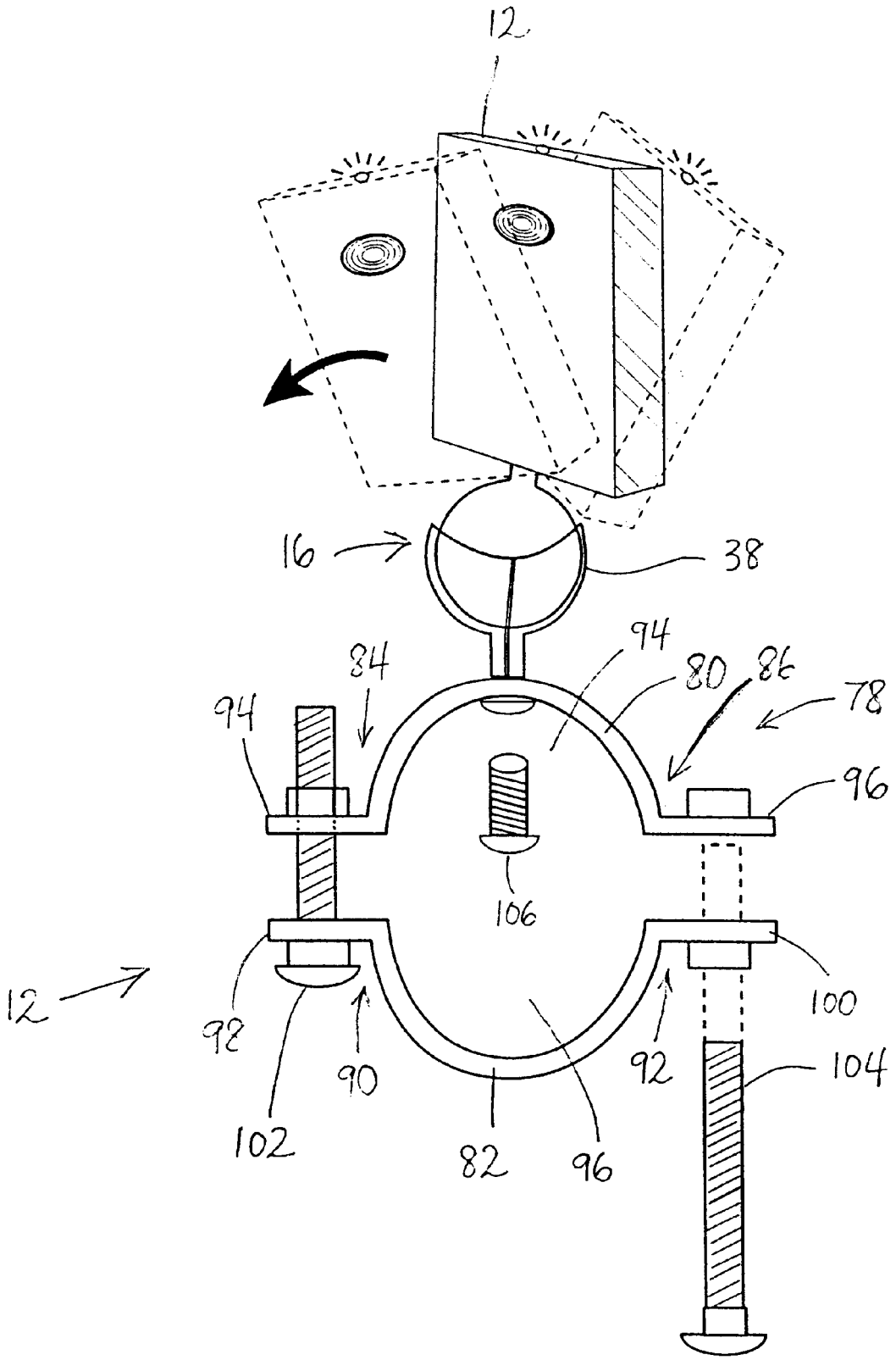
FIG. 6 is a perspective view of an apparatus for attaching or mounting a laser diode module shown with a fourth embodiment of a first means for attaching or mounting the laser diode module, along with a first embodiment of a second means for adjusting the laser diode module.

Referring also to FIG. 6, a fourth embodiment 78 of first means 12 for attaching or mounting a laser diode module 14, in accordance with the present invention, is generally shown. Fourth embodiment 78 comprises a first strip 80 and a second strip 82. First strip 80 includes a first end 84 and a second end 86, and second strip 82 includes a third end 90 and a fourth end 92. First strip 80 is curved such that a generally semi-circular opening 94 is formed between first end 84 and second end 86. Similarly, second strip 88 is curved such that a generally semi-circular opening 96 is formed between third end 90 and fourth end 92. A first tang 94 and a second tang 96 extends outwardly from first end 84 and second end 86, respectively, of first strip 80. Third tang 98 and fourth tang 100 extends outwardly from third end 90 and fourth end 92, respectively, of second strip 82. First strip 80 is oriented relative to second strip 82 such that first tang 94 and third tang 98 are adjacent and generally parallel to each other and second tang 96 and fourth tang 100 are adjacent and generally parallel to each other. In order to maintain first strip 80 and second strip 82 in a fixed position relative to each other, fourth embodiment 78 of first means 12 for attaching or mounting a laser diode module 14 further includes a first bolt means 102 and a second bolt means 104. First bolt means 102 threadably engages first tang 94 and third tang 98, while second bolt means 104 threadably engages second tang 96 and fourth tang 100, such that tightening first and second bolt means 102 and 104 draws and compresses first strip 80 and second strip 82 together.

In fourth embodiment 78 of first means 12, second means 16 for adjusting laser diode module 14 may also include ball and socket joint 38. Ball and socket joint 38 is connected to fourth embodiment 78 of first means 12 by a bolt or screw 106. It can be seen that fourth embodiment 78 of first means 12 is also ideally adapted for attachment around a generally linear It object, such as a pole or the like.

Figure 7:
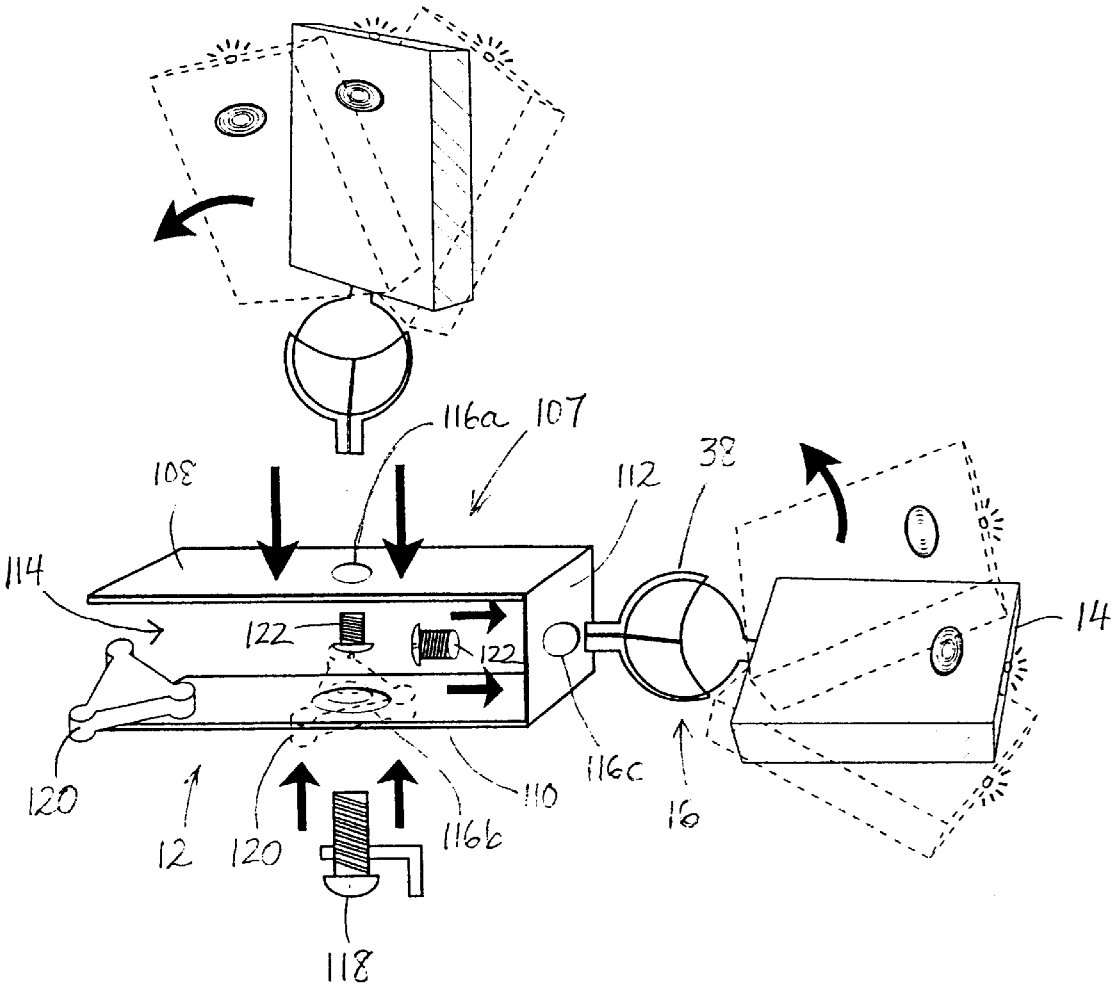
FIG. 7 is a perspective view of an apparatus for attaching or mounting a laser diode module shown with a fifth embodiment of a first means for attaching or mounting the laser diode module, along with a first embodiment of a second means for adjusting the laser diode module.
Figure 8:
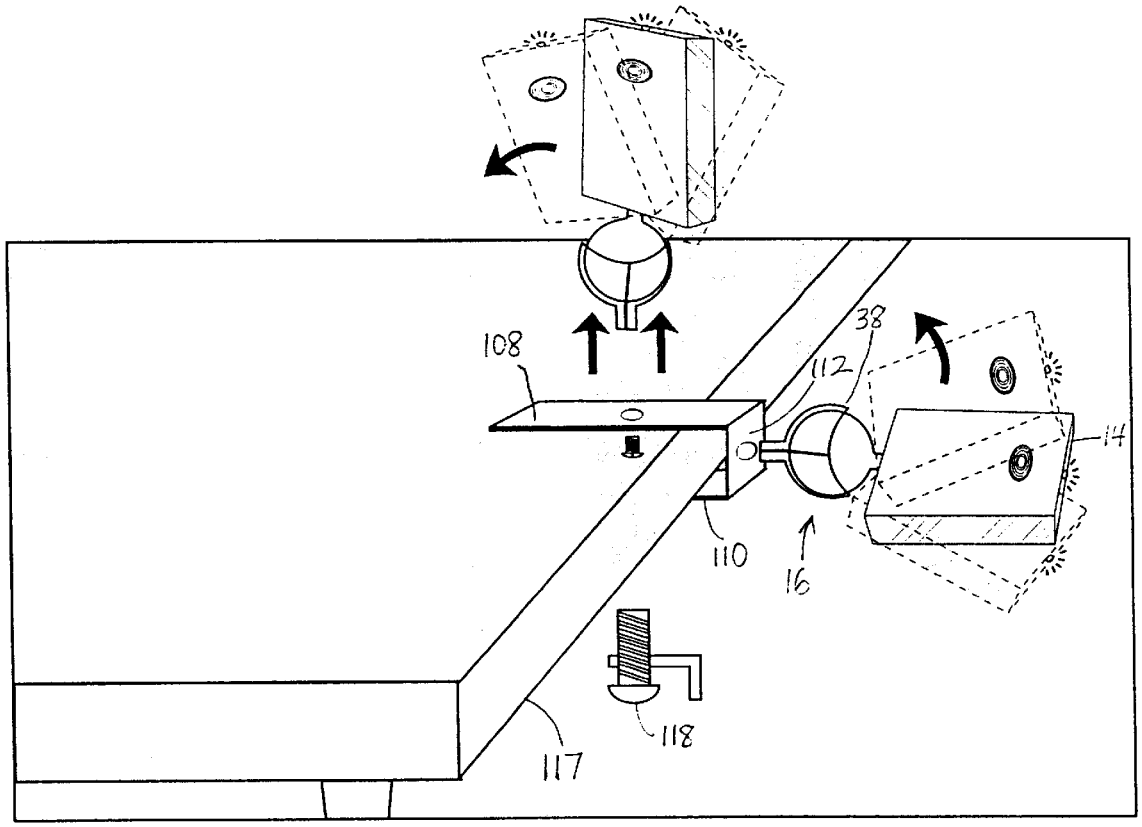
FIG. 8 is a perspective view of the apparatus shown in FIG. 7, shown attached to a table.

Referring also to FIG. 7 and FIG. 8, a fifth embodiment 107 of first means 12 for attaching or mounting laser diode module 14, in accordance with the present invention, is generally shown. Fifth embodiment 107 of first means 12 comprises an upper plate 108, a lower plate 110, and a center plate 112. Center plate 112 is integral to and attached to both upper plate 108 and lower plate 110 wherein a generally rectangular opening 114 is defined between upper plate 108 and lower plate 110. Upper plate 108, lower plate 110, and center plate 112, each includes a hole 116*a*, 116*b*, 116*c*, respectively, disposed therethrough. It can be seen that fifth embodiment 107 of first means 12 for attaching or mounting a laser diode module 14 is ideally adapted for attachment onto an edge of a planar surface, such as a table 117 or the like. A bolt 118 in conjunction with a clamping member 120 allows fifth embodiment 106 of first means 12 to be securely fastened onto the edge of an object.

In fifth embodiment 106 of first means 12 for attaching or mounting a laser diode module 14, second means 16 for adjusting laser diode module 14 may also include ball and socket joint 38. Ball and socket joint 38 is connected to fifth embodiment 106 of first means 12 by a bolt or screw 122 threaded through either hole 116*a* or hole 116*b*, depending on whether ball and socket joint 38 is positioned on upper plate 108 or center plate 112, respectively.

Figure 9:
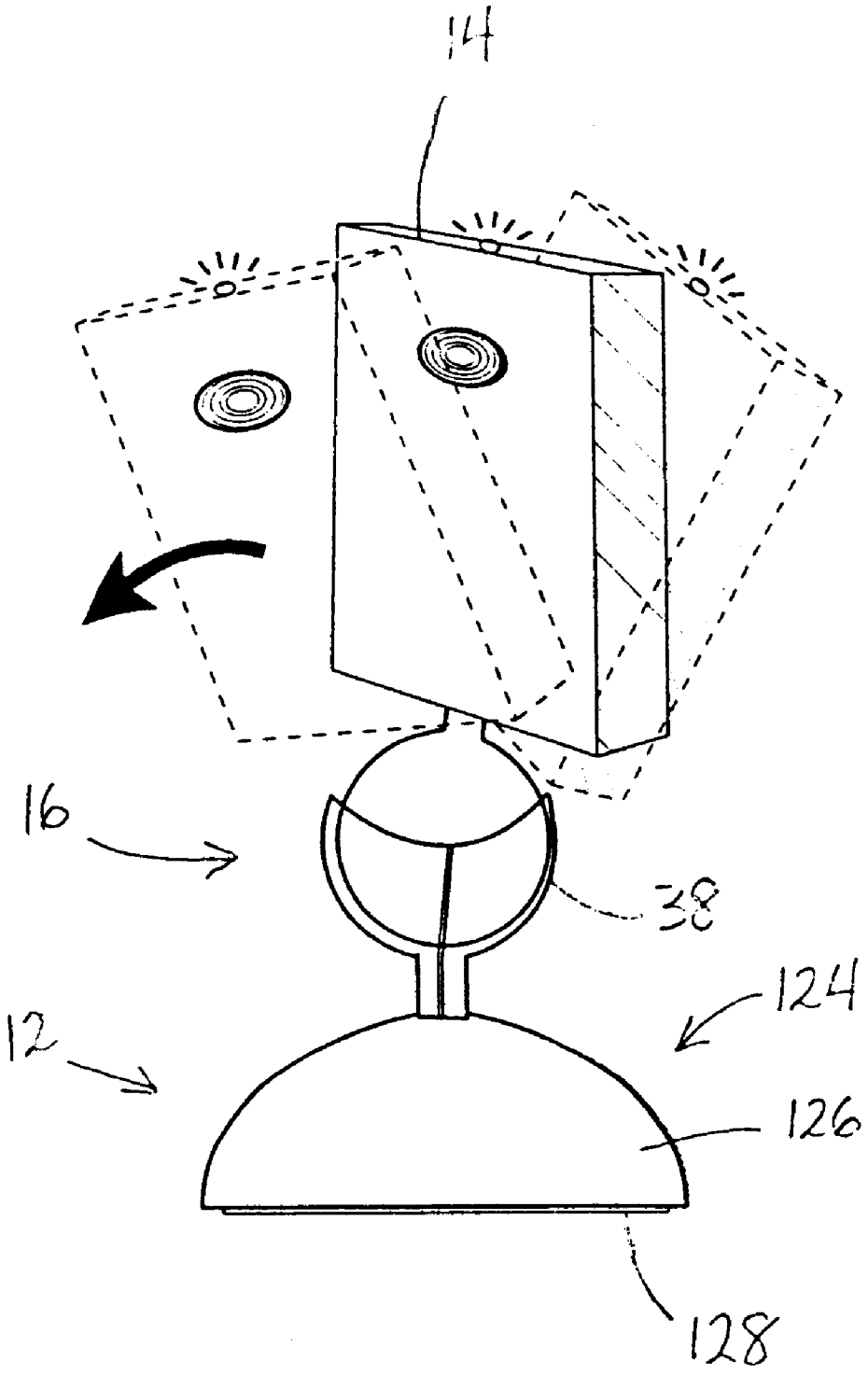
FIG. 9 is a perspective view of an apparatus for attaching or mounting a laser diode module shown with a sixth embodiment of a first means for attaching or mounting the laser diode module, along with a first embodiment of a second means for adjusting the laser diode module.

Referring also to FIG. 9, a sixth embodiment 124 of first means 12 for attaching or mounting a laser diode module 14, in accordance with the present invention, is generally shown. Sixth embodiment 124 of first means 12 comprises a housing 126 and a magnet 128. Magnet 128 is located within housing 126 such that a significant surface area of magnet 128 is exposed for attracting onto a ferrous surface, such as a refrigerator (not shown) or an automobile body (not shown).

In sixth embodiment 124 of first means 12 for attaching or mounting a laser diode module 14, second means 16 for adjusting laser diode module 14 may also include ball and socket joint 38. Ball and socket joint 38 is connected to sixth embodiment 124 of first means 12 by threading into or gluing ball and socket joint 38 to housing 126. Other means of connecting ball and socket joint 38 to housing 126 are contemplated, such as but not limited to, integrally molding or casting.

Figure 10:
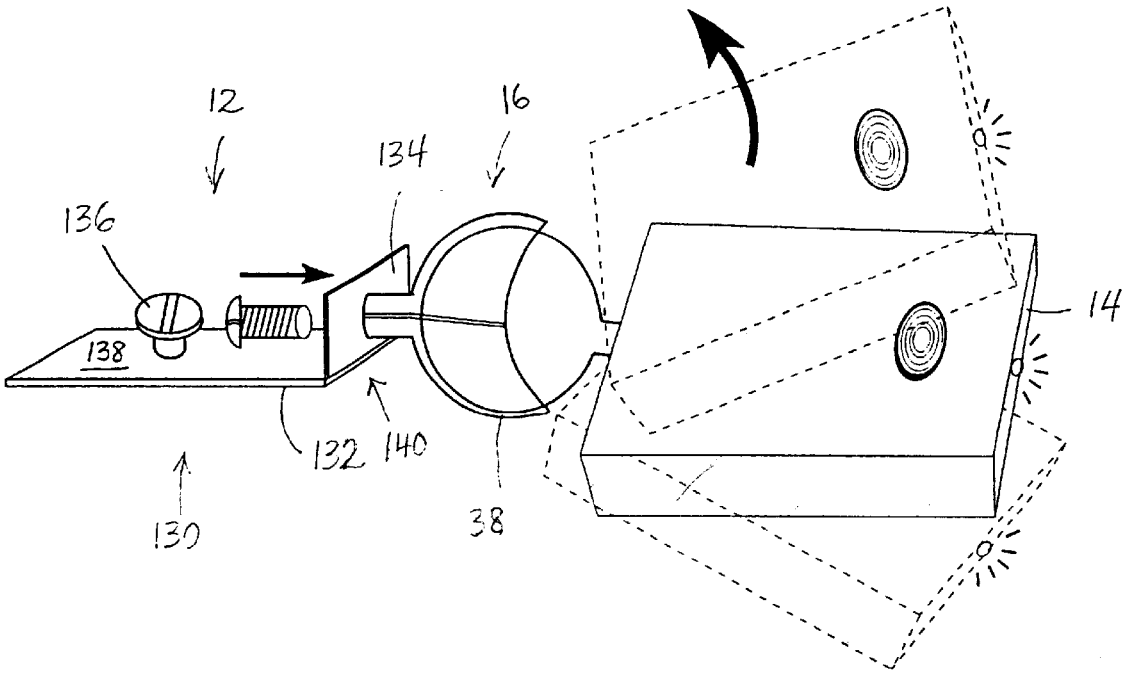
FIG. 10 is a perspective view of an apparatus for attaching or mounting a laser diode module shown with a seventh embodiment of a first means for attaching or mounting the laser diode module, along with a first embodiment of a second means for adjusting the laser diode module.

Referring also to FIG. 10, a seventh embodiment 130 of first means 12 for attaching or mounting a laser diode module 14, in accordance with the present invention, is generally shown. Seventh embodiment 130 of first means 12 comprises a plate 132, a support member 134, and a screw means 136. Plate 132 includes an upper surface 138 and an outer end 140. Support member 134 is integrally coupled to upper surface 138 of plate 132 and extends perpendicularly from outer end 140 thereof. Screw means 136 is disposed through plate 132 and is adapted for threading into an object for attaching seventh embodiment 130 thereto. Another means for attaching screw means 136 to an object is shown and described later. In seventh embodiment 130 of first means 12 for attaching or mounting a laser diode module 14, second means 16 for adjusting laser diode module 14 may also include ball and socket joint 38.

Figure 11:
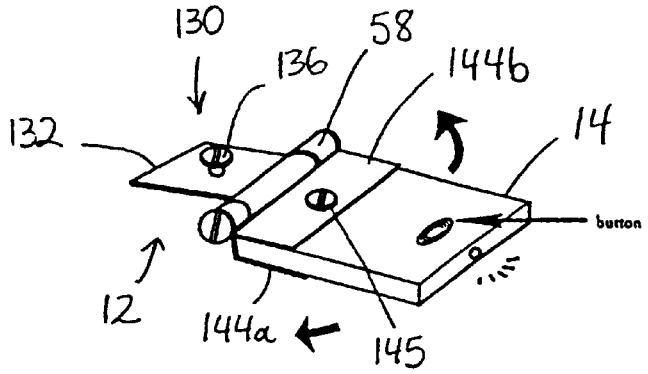
FIG. 11 is a perspective view of an apparatus for attaching or mounting a laser diode module shown with a seventh embodiment of a first means for attaching or mounting the laser diode module, along with a second embodiment of a second means for adjusting the laser diode module.
Figure 12:
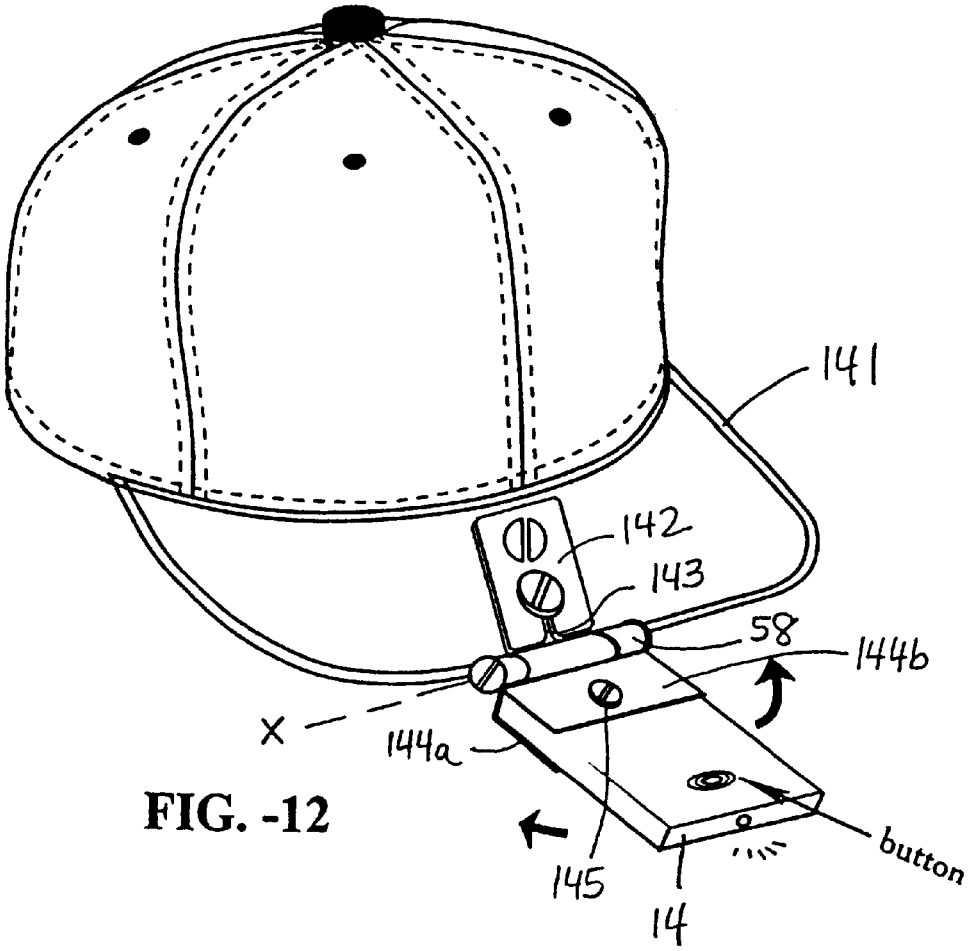
FIG. 12 is a perspective view of the apparatus shown in FIG. 11, shown attached to a cap.

Referring also to FIG. 11 and FIG. 12, first hinge assembly 58 is generally shown in combination with seventh embodiment 130 of first means 12 for attaching or mounting a laser diode module 14. First hinge assembly 58 may be connected to plate 132 of seventh embodiment 130 for attaching a laser diode module 14, by welding, gluing, integrally molding, or the like. First hinge assembly 58 may also be connected to second embodiment 46 for attaching a laser diode module 14.

It can be seen that seventh embodiment 130 of first means 12 for attaching or mounting a laser diode module 14 may be attached to a cap 141 wherein plate 132 is slidably engaged within Is a clip 142 affixed onto cap 141. Clip 142 includes a narrow channel 143 that receives screw means 136 and imposes compressive force thereon to hold plate 132 within clip 142. Attachment mechanism 18 for securing first hinge assembly 58 to laser diode module 14 comprises a pair of plates 144*a* and 144*b* disposed in a generally parallel fashion so as to accommodate laser diode module 14 placed therebetween. A bolt or screw 145 is threaded through plate 144B and into laser diode module 14. First hinge assembly 58 allows for the directional adjustability of laser diode module 14 by providing pivotability of laser diode module 14 around axis "x".

Figure 13:
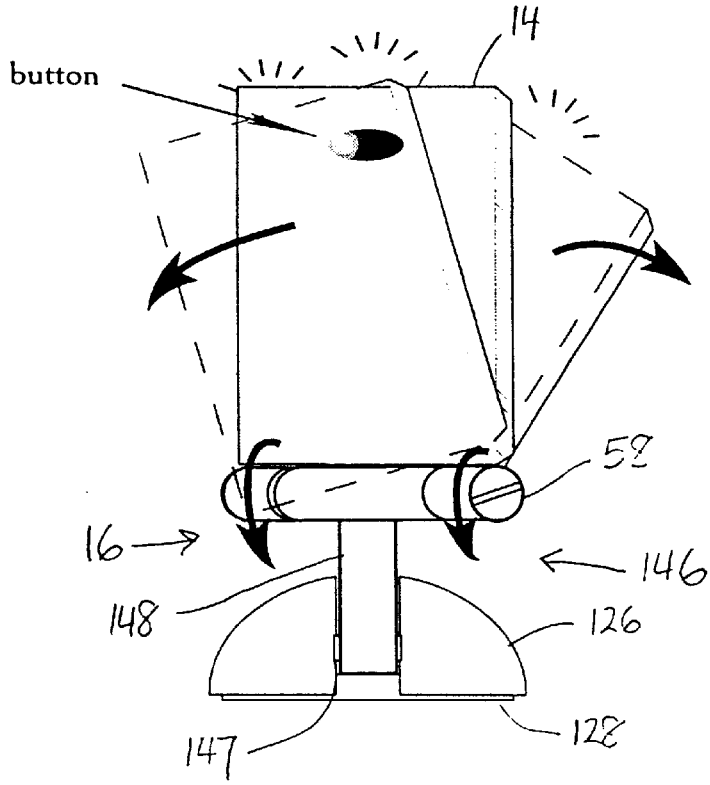
FIG. 13 is a perspective view of an apparatus for attaching or mounting a laser diode module shown with a sixth embodiment of a first means for attaching or mounting the laser diode module, along with a third embodiment of a second means for adjusting the laser diode module.
Figure 14:
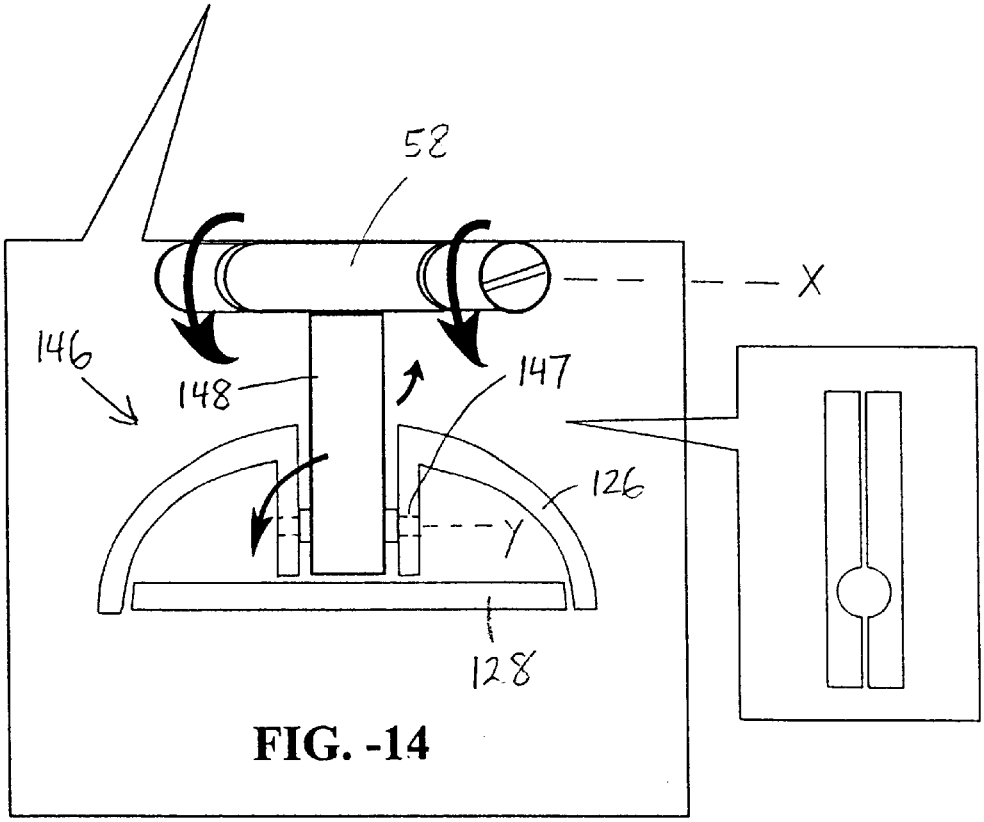
FIG. 14 is a cross-sectional view of the sixth embodiment of a first means for attaching or mounting the laser diode module, shown in FIG. 13.

Referring also to FIG. 13 and FIG. 14, a third embodiment 146 of second means 16 for adjusting laser diode module 14, in accordance with the present invention, is generally shown. Third embodiment 146 of second means 16 for adjusting laser diode module 14 comprises first hinge assembly 58 and a second hinge assembly 147 attached to first hinge assembly 58 by a post 148. Second hinge assembly 147 resides within housing 126 and is capable of pivoting around a second axis "y" that is perpendicular to axis "x" that first hinge assembly 58 pivots around. It can be seen that third embodiment 146 of second means 16 for adjusting laser diode module 14 provides for adjustment of laser diode module 14 around two perpendicular axes of rotation, "x" and "y".

Figure 15:
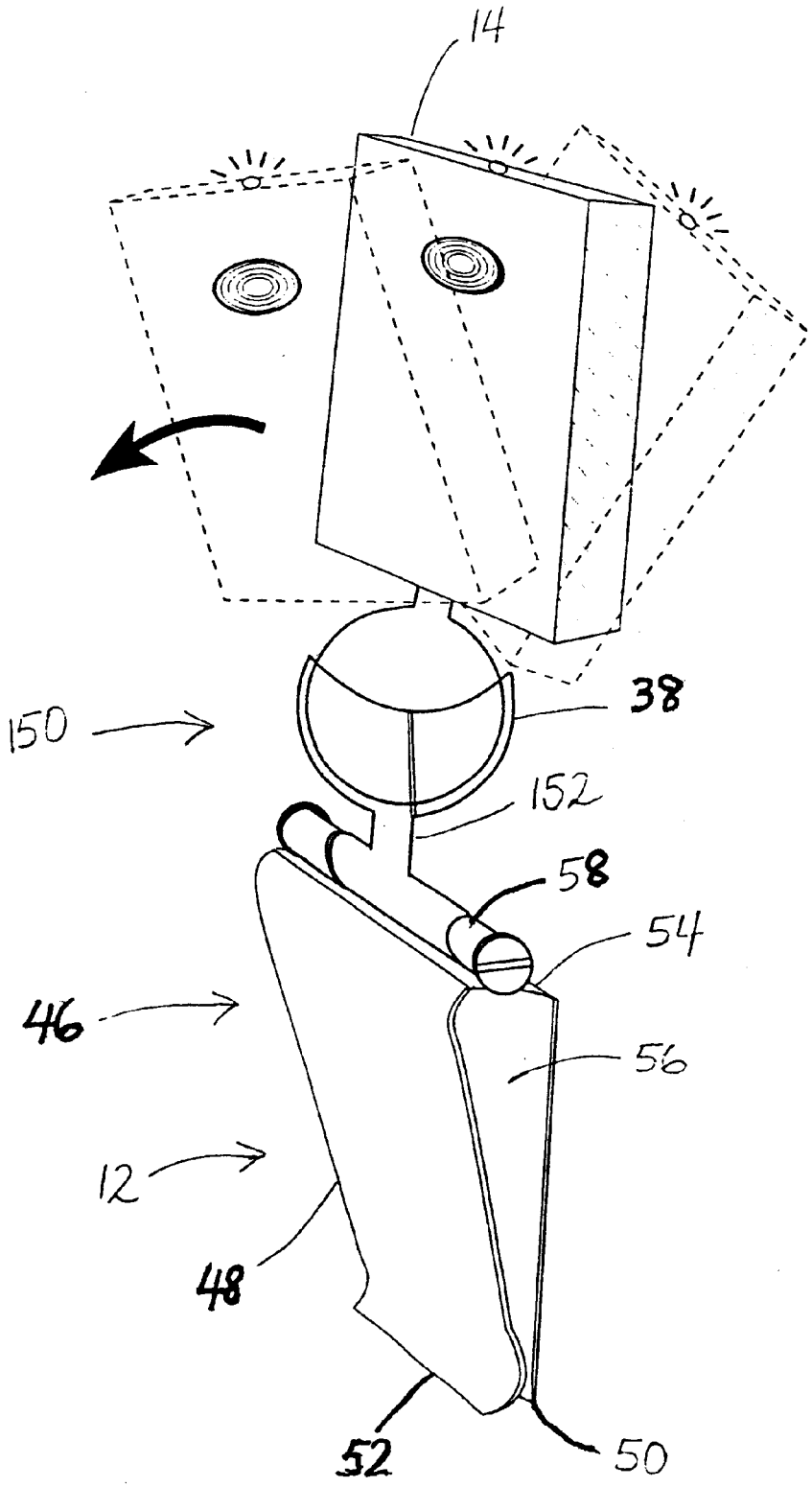
FIG. 15 is a perspective view of an apparatus for attaching or mounting a laser diode module shown with the second embodiment of a first means for attaching or mounting the laser diode module, along with a fourth embodiment of a second means for adjusting the laser diode.
Figure 16:
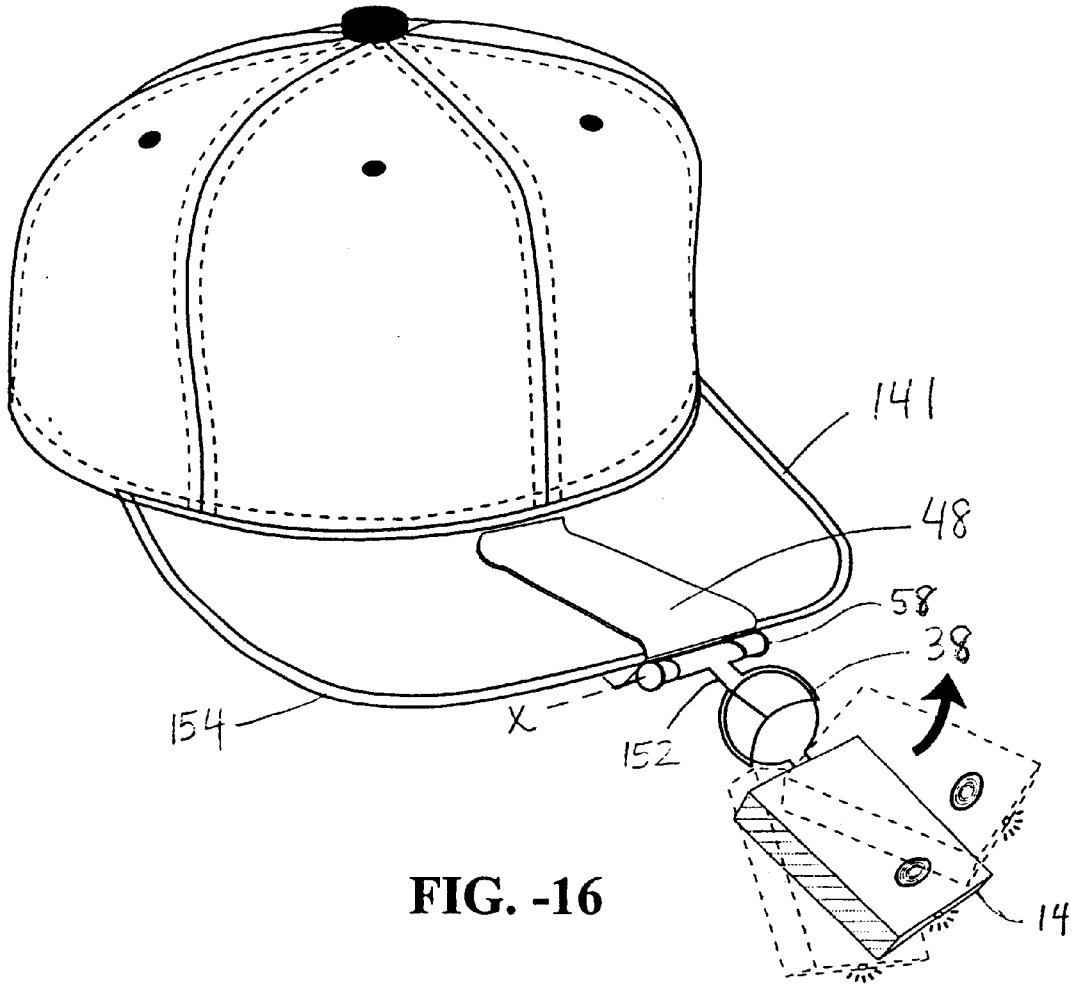
FIG. 16 is a perspective view of the apparatus shown in FIG. 15, shown attached to a cap.

Referring also to FIG. 15 and FIG. 16, a fourth embodiment 150 of means 16 for adjusting a laser diode module 14, in accordance with the present invention, is generally shown. Fourth embodiment 150 of means 16 for adjusting a laser diode module 14 is shown connected to second embodiment 46 of means 12 for attaching or mounting laser diode module 14. Fourth embodiment 150 of means 16 for adjusting a laser diode module 14 comprises ball and socket joint 38 attached to first hinge assembly 58 by a post 152.

It may be seen that second embodiment 46 of means 12 for attaching or mounting laser diode module 14 may be attached to a cap 141 by inserting the visor 154 between first edge 50 and second edge 52 and sliding visor 154 through gap 56. It may be further seen that fourth embodiment 150 of means 16 for adjusting a laser diode module 14 allows for an increased range of adjustabilty of laser diode module 14 since laser diode module 14 may swivel with ball and socket joint 38 while ball and socket joint 38 may pivot around axis "x" of first hinge assembly 58.

Accordingly, it will be seen that this invention provides for attaching or mounting a laser diode module that enables the laser diode module to be aimed or pointed at a specified location while the laser diode module is either attached to some item of apparel worn by the user or mounted on an object. Although the description above contains many specificities, these should not be construed as limiting the scope of the invention but as merely providing illustrations of some of the presently preferred embodiments of this invention. Thus the scope of this invention should be determined by the appended claims and their legal equivalents.

What is claimed is:

1. An apparatus for attaching or mounting a laser diode module onto an object, comprising:

(a) a laser diode module, said laser diode module having a laser emitter means and a laser dispersion means, the combination of said laser emitter means and said laser dispersion means produces a display picture image;

(b) a means for attaching said laser diode module onto an object being provided;

(c) a means for adjusting said laser diode module, said means for adjusting said laser diode module connected to said means for attaching a laser diode module; and (d) an attachment mechanism for securing said means for adjusting said laser diode module to said laser diode module;

(e) said laser diode module secured to said means for adjusting said laser diode module.

2. An apparatus as recited in claim 1, wherein said display picture image being selected from the group consisting of a representation, a depiction, a sign, an interpretation, a description, a model, a diagram, a doodle, an outline, a symbol, a design, a figure, a graphic, a visual aid, a rendering, an impression, a semblance, a plan, a piece, a drawing, an illustration, a portrait, a photograph, a likeness, a semblance, a similitude, a portrayal, a caricature, a cartoon, a sketch, a comic strip, or a delineation.

3. An apparatus as recited in claim 1, wherein said first means for attaching a laser diode module comprises:

(a) a plate, said plate including an upper end, a lower end, a front face, and a rear face;

(b) a gripping member disposed on said rear face of said plate, said gripping member including an upwardly disposed handle and a lower extent;

(c) a pivot assembly for coupling said gripping member to said plate; and (d) a spring for biasing said gripping member, whereby said lower extent of said gripping member is compressed against said rear face of said plate in a rest orientation.

4. An apparatus as recited in claim 1, wherein said first means for attaching a laser diode module comprises a planar strip, said planar strip including a first edge, a second edge, and a center section, said center section being generally curved such that said first edge is disposed adjacent said second edge and a gap formed therebetween, said gap tapering from said center section towards said first and second edges.

5. An apparatus as recited in claim 1, wherein said first means for attaching a laser diode module comprises:

(a) a strip, said strip including a first end and a second end, said strip being curved such that a generally circular opening is formed therein;

(b) a first tang and a second tang, said first tang extending outwardly from said first end and said second tang extending outwardly from said second end, wherein said first and said second tangs are generally parallel; and (c) bolt means for holding said first and said second tangs, in a fixed position relative to each other.

6. An apparatus as recited in claim 1, wherein said first means for attaching a laser diode module comprises:

(a) a first strip and a second strip, said first strip including a first end and a second end, said second strip including a third end and a fourth end, said first strip being curved such that a generally semi-circular opening is formed between said first end and a second end, said second strip being curved such that a generally semi-circular opening is formed between said third end and said fourth end;

(b) a first tang, a second tang, a third tang, and a fourth tang, said first tang extending outwardly from said first end and said second tang extending outwardly from said second end, said third tang extending outwardly from said third end and said fourth tang extending outwardly from said fourth end, wherein said first tang and said third tang are disposed adjacent and generally parallel to each other and wherein said second tangs and said fourth tang are adjacent and generally parallel to each other; and (c) a first bolt means and a second bolt means, said first bolt means adapted for holding said first and third second tangs in a fixed position relative to each other, said second bolt means adapted for holding said second and said fourth tangs in a fixed position relative to each other.

7. An apparatus as recited in claim 1, wherein said first means for attaching a laser diode module comprises:

(a) an upper plate and a lower plate;

(b) a center plate integral to and attached to both said upper plate and said lower plate, wherein a generally rectangular gap is defined between said upper plate and said lower plate; and (c) bolt means incorporated in said lower plate, said bolt means adapted to move towards said upper plate upon rotation of said bolt means, thereby exerting a compressive force on an object inserted therebetween.

8. An apparatus as recited in claim 1, wherein said first means for attaching a laser diode module comprises a housing, said housing including a magnet disposed therein.

9. An apparatus as recited in claim 1, wherein said first means for attaching a laser diode module comprises:

(a) a plate, said plate including an upper surface and an outer end;

(b) a support member integrally coupled to said upper surface of said plate, said support member extending perpendicularly from said outer end of said plate; and (c) a screw means passing through said plate.

10. An apparatus as recited in claim 1, wherein said adjustment mechanism comprises a ball and socket joint.

11. An apparatus as recited in claim 1, wherein said adjustment mechanism comprises a first hinge assembly capable of pivoting around a first axis.

12. An apparatus as recited in claim 11, wherein said adjustment mechanism further comprises a ball and socket joint coupled to said first hinge assembly.

13. An apparatus as recited in claim 11, wherein said adjustment mechanism further comprises a second hinge assembly coupled to said first hinge assembly, said second hinge assembly capable of pivoting around a second axis, wherein said second axis is generally perpendicular to said first axis.

14. An apparatus as recited in claim 1, wherein said second means for securing said adjustment mechanism comprises at least one screw.

15. An apparatus for attaching or mounting a laser diode module onto an object, comprising:

(a) a laser diode module, said laser diode module having a laser emitter means and a laser dispersion means, the combination of said laser emitter means in said laser dispersion means produces a display letter image;

(b) a means for attaching said laser diode module onto an object;

(c) a means for adjusting said laser diode module, said means for adjusting said laser diode module connected to said means for attaching a laser diode module; and (d) an attachment mechanism for securing said means for adjusting said laser diode module to said laser diode module;

(e) said laser diode module secured to said means for adjusting said laser diode module.

16. An apparatus as recited in claim 15, wherein said display letter image being selected from the group consisting of script, a note, a memo, at least one alpha-numeric symbol, a communication, initials, an epistle, a notification, a missive, at least one contraction, a statement, at least one acronym, at least one word, at least one phrase, at least one slogan, at least one expression, at least one remark, at least one declaration, at least one saying, at least one idiom, at least one axiom, at least one slogan, at least one turn of phrase, at least one motto, at least one jingle, at least one catch phrase, at least one watch word, or at least one sentence.

17. An apparatus as recited in claim 15, wherein said first means for attaching a laser diode module comprises:

(a) a plate, said plate including an upper end, a lower end, a front face, and a rear face;

(b) a gripping member disposed on said rear face of said plate, said gripping member including an upwardly disposed handle and a lower extent;

(c) a pivot assembly for coupling said gripping member to said plate; and (d) a spring for biasing said gripping member, whereby said lower extent of said gripping member is compressed against said rear face of said plate in a rest orientation.

18. An apparatus as recited in claim 15, wherein said first means for attaching a laser diode module comprises a planar strip, said planar strip including a first edge, a second edge, and a center section, said center section being generally curved such that said first edge is disposed adjacent said second edge and a gap formed therebetween, said gap tapering from said center section towards said first and second edges.

19. An apparatus as recited in claim 15, wherein said adjustment mechanism comprises a ball and socket joint.

20. An apparatus as recited in claim 15, wherein said adjustment mechanism comprises a first hinge assembly capable of pivoting around a first axis.

21. An apparatus as recited in claim 20, wherein said adjustment mechanism further comprises a ball and socket joint coupled to said first hinge assembly.

22. An apparatus as recited in claim 20, wherein said adjustment mechanism further comprises a second hinge assembly coupled to said first hinge assembly, said second hinge assembly capable of pivoting around a second axis, wherein said second axis is generally perpendicular to said first axis.

23. An apparatus for attaching or mounting a laser diode module onto an object, comprising:

(a) a laser diode module, said laser diode module having a laser emitter means and a laser dispersion means, the combination of said laser emitter means and said laser dispersion means produces a display picture image and display letter image combination;

(b) a means for attaching said laser diode module onto an object;

(c) a means for adjusting said laser diode module, said means for adjusting said laser diode module connected to said means for attaching a laser diode module; and (d) an attachment mechanism for securing said means for adjusting said laser diode module to said laser diode module;

(e) said laser diode module secured to said means for adjusting said laser diode module.

24. An apparatus as recited in claim 23, wherein said display picture image being selected from the group consisting of a representation, a depiction, a sign, an interpretation, a description, a model, a diagram, a doodle, an outline, a symbol, a design, a figure, a graphic, a visual aid, a rendering, an impression, a semblance, a plan, a piece, a drawing, an illustration, a portrait, a photograph, a likeness, a semblance, a similitude, a portrayal, a caricature, a cartoon, a sketch, a comic strip, or a delineation.

25. An apparatus as recited in claim 23, wherein said display letter image being selected from the group consisting of script, a note, a memo, at least one alpha-numeric symbol, a communication, initials, an epistle, a notification, a missive, at least one contraction, a statement, at least one acronym, at least one word, at least one phrase, at least one slogan, at least one expression, at least one remark, at least one declaration, at least one saying, at least one idiom, at least one axiom, at least one slogan, at least one turn of phrase, at least one motto, at least one jingle, at least one catch phrase, at least one watch word, or at least one sentence.

26. An apparatus as recited in claim 23, wherein said first means for attaching a laser diode module comprises:

(a) a plate, said plate including an upper end, a lower end, a front face, and a rear face;

(b) a gripping member disposed on said rear face of said plate, said gripping member including an upwardly disposed handle and a lower extent;

(c) a pivot assembly for coupling said gripping member to said plate; and (d) a spring for biasing said gripping member, whereby said lower extent of said gripping member is compressed against said rear face of said plate in a rest orientation.

27. An apparatus as recited in claim 23, wherein said first means for attaching a laser diode module comprises a planar strip, said planar strip including a first edge, a second edge, and a center section, said center section being generally curved such that said first edge is disposed adjacent said second edge and a gap formed therebetween, said gap tapering from said center section towards said first and second edges.

28. An apparatus as recited in claim 23, wherein said adjustment mechanism comprises a ball and socket joint.

29. An apparatus as recited in claim 23, wherein said adjustment mechanism comprises a first hinge assembly capable of pivoting around a first axis.

30. An apparatus as recited in claim 27, wherein said adjustment mechanism further comprises a ball and socket joint coupled to said first hinge assembly.

31. An apparatus as recited in claim 27, wherein said adjustment mechanism further comprises a second hinge assembly coupled to said first hinge assembly, said second hinge assembly capable of pivoting around a second axis, wherein said second axis is generally perpendicular to said first axis.

* * * * *